US009356398B2

(12) United States Patent
Nakayama et al.

(10) Patent No.: US 9,356,398 B2
(45) Date of Patent: May 31, 2016

(54) LOCK MECHANISM OF SHIELD CONNECTOR

(75) Inventors: Kouichi Nakayama, Makinohara (JP); Tsuyoshi Mizushima, Makinohara (JP)

(73) Assignee: Yazaki Corporation, Tokyo (JP)

( * ) Notice: Subject to any disclaimer, the term of this patent is extended or adjusted under 35 U.S.C. 154(b) by 30 days.

(21) Appl. No.: 13/985,212

(22) PCT Filed: Feb. 13, 2012

(86) PCT No.: PCT/JP2012/053234

§ 371 (c)(1), (2), (4) Date: Aug. 13, 2013

(87) PCT Pub. No.: WO2012/111593

PCT Pub. Date: Aug. 23, 2012

(65) Prior Publication Data

US 2013/0316579 A1 Nov. 28, 2013

(30) Foreign Application Priority Data

Feb. 14, 2011 (JP) ..... 2011-028220

(51) Int. Cl.
*H01R 13/627* (2006.01)
*H01R 13/648* (2006.01)
(Continued)

(52) U.S. Cl.
CPC ..... *H01R 13/648* (2013.01); *H01R 13/506* (2013.01); *H01R 13/627* (2013.01); *H01R 13/6581* (2013.01); *H01R 13/6596* (2013.01)

(58) Field of Classification Search
CPC ..... H01R 13/648; H01R 13/6581; H01R 13/6273; H01R 13/6272; H01R 13/627
USPC ..... 439/607.01, 352, 353, 607.19, 607.23, 439/607.24, 607.25, 607.44, 298, 309, 308, 439/328, 331, 370, 153, 333, 555
See application file for complete search history.

(56) References Cited

U.S. PATENT DOCUMENTS 4,711,507 A * 12/1987 Noorily ..... 439/292
5,518,421 A 5/1996 Davis
(Continued)

FOREIGN PATENT DOCUMENTS

JP H06-243933 A 9/1994
JP 11-040272 2/1999
(Continued)

OTHER PUBLICATIONS

Supplementary European Search Report dated Jun. 25, 2014, issued for the European patent application No. 12747723.0.
(Continued)

*Primary Examiner* — Abdullah Riyami
*Assistant Examiner* — Harshad Patel
(74) *Attorney, Agent, or Firm* — Locke Lord LLP; James E. Armstrong, IV; Brian S. Matross

(57) ABSTRACT

A shield connector is for assembling of a connector housing and a shield shell acted by a small insertion force and locking the connector housing and the shield shell by a large holding force. A flexible lock arm having a projection projecting outwardly is arranged at an insulation connector housing. A locked member engaged with the projection is arranged at a shield shell in which the connector housing is inserted. When the projection is half locked with the locked member, the lock arm is prevented from bending to unlock. When the connector housing is inserted into the shield shell, the lock arm is bent and also the projection is press-fitted along an inner surface of the shield shell. A stopper facing and abutting on an inner surface along a bending direction of the lock arm is arranged at an outer surface of the connector housing.

2 Claims, 4 Drawing Sheets

(51) Int. Cl.

| | |
|---|---|
| ***H01R 13/506*** | (2006.01) |
| ***H01R 13/6581*** | (2011.01) |
| *H01R 13/6596* | (2011.01) |

(56) References Cited

U.S. PATENT DOCUMENTS

| | | | | |
|---|---|---|---|---|
| 5,525,074 | A * | 6/1996 | Tsuji et al. | 439/555 |
| 6,146,182 | A | 11/2000 | Wang et al. | |
| 6,676,433 | B1 * | 1/2004 | Ozaki | 439/353 |
| 7,425,155 | B2 | 9/2008 | Takeuchi | |
| 7,959,469 | B2 | 6/2011 | Kawamura et al. | |
| 2002/0155746 | A1 * | 10/2002 | Simpson | 439/357 |
| 2006/0194469 | A1 * | 8/2006 | Miyakawa | H01R 13/6272 439/357 |
| 2007/0066118 | A1 * | 3/2007 | Oma | H01R 13/6273 439/357 |
| 2009/0093157 | A1 | 4/2009 | Aoki et al. | |
| 2010/0178805 | A1 * | 7/2010 | Yong et al. | 439/607.41 |
| 2010/0216323 | A1 | 8/2010 | Kawamura et al. | |
| 2011/0195603 | A1 * | 8/2011 | Fujiwara et al. | 439/607.28 |

FOREIGN PATENT DOCUMENTS

| | | | |
|---|---|---|---|
| JP | 2001-326034 | A | 11/2001 |
| JP | 2008-103114 | A | 5/2008 |
| JP | 2010-198779 | A | 9/2010 |

OTHER PUBLICATIONS

International Search Report dated Mar. 19, 2012 for International Application No. PCT/JP2012/053234.

* cited by examiner

LOCK MECHANISM OF SHIELD CONNECTOR

TECHNICAL FIELD

This invention relates to an lock mechanism of shield connector in which a projection of a flexible lock arm of an insulation connector housing is locked to a hole of a conductive shield shell.

BACKGROUND ART

Various lock mechanisms of shield connector, which is provided at a car, for locking a housing made of insulation resin and a conductive metal shield shell arranged at outer side of the housing are proposed.

For example, in Patent document 1, a shield connector, not lock mechanism, in which an insulation housing of an apparatus-side connector is passed through a hole of a case of an apparatus; and a shield shell by aluminum die-cast is arranged at an outside of the insulation housing; and the shield shell is connected and fixed at the case by a bolt; and a terminal of the power-supply-side connector is connected with a terminal inserted through the insulation housing by bolt fixing; and a thin-wall shield shell is provided at the power-supply-side connector, is described.

In Patent document 2, a lock mechanism of shield connector, in which a rectangular-shape flexible lock piece facing inside of a shield shell is locked to an inner connector housing, is described. In Patent document 3, a lock apparatus of shield connector, in which a projection of a connector housing is engaged with a hole of an outside shield shell, is described. In Patent document 4, a lock mechanism of shield connector, in which a flexible lock arm facing inside of a connector housing is locked with a step member of an inner shield shell, is described. In Patent document 5, a lock mechanism of shield connector, in which a projection of a connector housing is engaged with a hole of a shield shell, is described.

CITATION LIST

Patent Document

Patent Document 1: Japan Patent Application Published No. 2010-198779

Patent Document 2: Japan Patent Application Published No. H11-40272

Patent Document 3: Japan Patent Application Published No. H6-243933

Patent Document 4: Japan Patent Application Published No. 2001-326034

Patent Document 5: Japan Patent Application Published No. 2008-103114

SUMMARY OF INVENTION

Objects to be Solved

According to the above usual lock mechanism of shield connector, when a flexible lock arm of a connector housing is engaged with a recess or a step portion of a shield shell, the lock arm can be bent, so that the shield shell can be assembled to an outside of the connector housing by a low insertion force. Conversely, the lock arm is easily bent so that holding force (lock force) for the heavy shield shell by aluminum die-cast is weakened. Thereby, the shield shell may be easily pulled out from a connector housing.

Furthermore, when a lock projection provided at a wall of a connector housing is engaged by pressure with a hole of the shield shell (lock projection is pressed along an inner wall of the shield shell into a hole so as to be engaged), the lock projection may be scraped or crushed so that there is a problem that the lock projection can not supply high holding force (lock force).

According to the above problems, an object of the present invention is to provide a lock mechanism of shield connector in which by solving both that assembling of a connector housing and a shield shell can be acted by a small insertion force but a holding force is small and that a holding force may be reduced by crushing the lock projection when press fitting, assembling of a connector housing and a shield shell can be acted by a small insertion force, and the connector housing and the shield shell can be locked by a large holding force.

How to Attain the Object of the Present Invention

In order to overcome the above problems and attain the object, a lock mechanism of shield connector claimed in claim 1 of the present invention includes a insulation connector housing; a flexible lock arm having a lock projection projecting outwardly and being arranged at the connector housing; a conductive shield shell in which the connector housing is inserted; a locked member provided at the shield shell so as to be locked with the lock projection; and when the lock projection is half-locked with the locked member, the lock arm is prevented from bending to unlock the lock arm, and when the connector housing is inserted into the shield shell, the lock arm is bent and the projection is press-fitted along an inner surface of the shield shell.

According to the above structure, when the connector housing is inserted into the shield shell, the projection of the lock arm is pushed by the inner surface of the shield shell and the lock arm is bent inwardly. A deflection value of the lock arm is given by a condition when the lock projection is half-locked with the locked member, and reduced to be smaller than a usual value. Thereby, the projection is inserted smoothly along the inner surface of the shield shell with a smaller press-fit value than usual, so that the projection is prevented from scraping and crushing. When the projection reaches the locked member, the lock arm is restored so that the projection is engaged completely with the locked member with a large lock area. In this condition, when a force to unlock is loaded at the lock arm, the lock arm is bent but the projection is half-locked with the locked member. Thereby, unlocking of the engaging is prevented and the shield shell is prevented from pulling out. Meaning of "half-locked" is "locked" by a small lock area of half of complete large lock area. The deflection value of the lock arm can be controlled by a stopper arranged at the lock arm or the connector housing, or by touching an inner surface of the lock arm directly to an outer surface of the connector housing without providing the stopper.

The lock mechanism of shield connector is characterized in that a stopper, which abuts on an inner surface along a bending direction of the lock arm, is provided at an outer surface of the connector housing so as to correspond to the inner surface of the lock arm.

According to the above structure, when the connector housing is inserted into the shield shell, the projection of the lock arm is pushed by the inner surface of the shield shell and the lock arm is bent inwardly. The inner surface of the lock arm abuts on the stopper of the connector housing so as to limit the lock arm not to be bent moreover. When the lock arm is unexpectedly bent after the shield shell is mounted at the connector housing, the inner surface of the lock arm abuts on the stopper of the connector housing so as to limit the lock arm not to be bent moreover, so that the shield shell is prevented from pulling out. By designing suitably a projecting height of the stopper, the press-fit value of the projection of the lock arm corresponding to workability of inserting the shield shell and performance of preventing unexpected unlock can be adjusted.

The lock mechanism of shield connector is characterized in that a stopper, which abuts on an outer surface of the connector housing, is provided at an inner surface along a bending direction of the lock arm so as to correspond to the outer surface of the connector housing.

According to the above structure, when the connector housing is inserted into the shield shell, the projection of the lock arm is pushed by the inner surface of the shield shell and the lock arm is bent inwardly. The outer surface of the connector housing abuts on the stopper of the lock arm so as to limit the lock arm not to be bent moreover. When the lock arm is unexpectedly bent after the shield shell is mounted at the connector housing, the stopper of the lock arm abuts on the outer surface of the connector housing so as to limit the lock arm not to be bent moreover, so that the shield shell is prevented from pulling out. By designing suitably a projecting height of the stopper, the press-fit value of the projection of the lock arm corresponding to workability of inserting the shield shell and performance of preventing unexpected unlock can be adjusted.

Effects of the Invention

According to the present invention claimed in claim 1, the connector housing and the shield shell can be assembled easily and smoothly by a small insertion force, and the connector housing and the shield shell can be locked by a large holding force without pulling-out. Thereby, workability of assembling the shield connector can be improved, and quality of assembling the shield connector can be improved by preventing pulling-out of the shield shell when transferring the shield connector.

According to the present invention, the inner surface of the lock arm is abutted on the stopper of the connector housing so as to limit securely the deflection of the lock arm, so that the effect of the invention can be promoted.

According to the present invention, the stopper of the lock arm is abutted on the outer surface of the connector housing so as to limit securely the deflection of the lock arm, so that the effect of the invention can be promoted.

DESCRIPTION OF EMBODIMENTS

FIGS. 1-8 show a first embodiment of a lock mechanism of shield connector according to the present invention.

Figure 1:
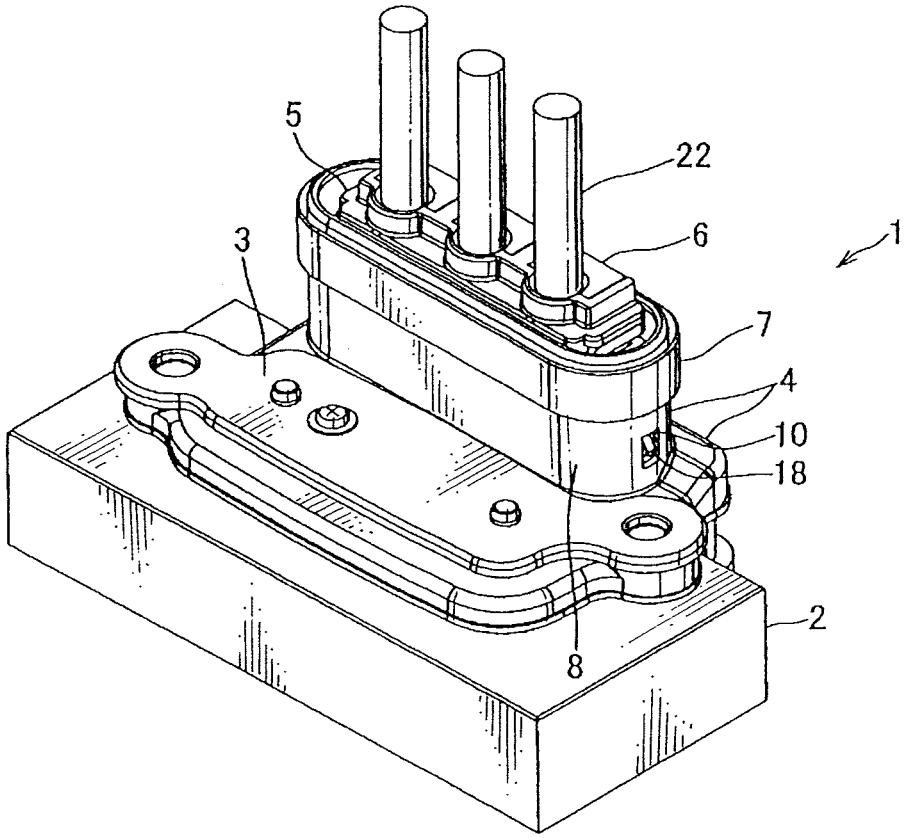
FIG. 1 is a perspective view of an assembled shield connector including a first embodiment of a lock mechanism of shield connector according to the present invention.

As shown in FIG. 1, a shield connector 1 includes a shield shell 4 made by aluminum die-cast (electric conductive metal), which is connected and fixed together with a cover 3 to a case made of electric conductive metal of an apparatus by fastening with a bolt; a connector housing 5 made of insulation resin which is arranged inside the shield shell 4; a holder 6 made of synthetic resin which is arranged at a wire-lead-out side (top side) of the connector housing 5; and a shield ring 7 arranged at a top of the shield shell 4.

Figure 2:
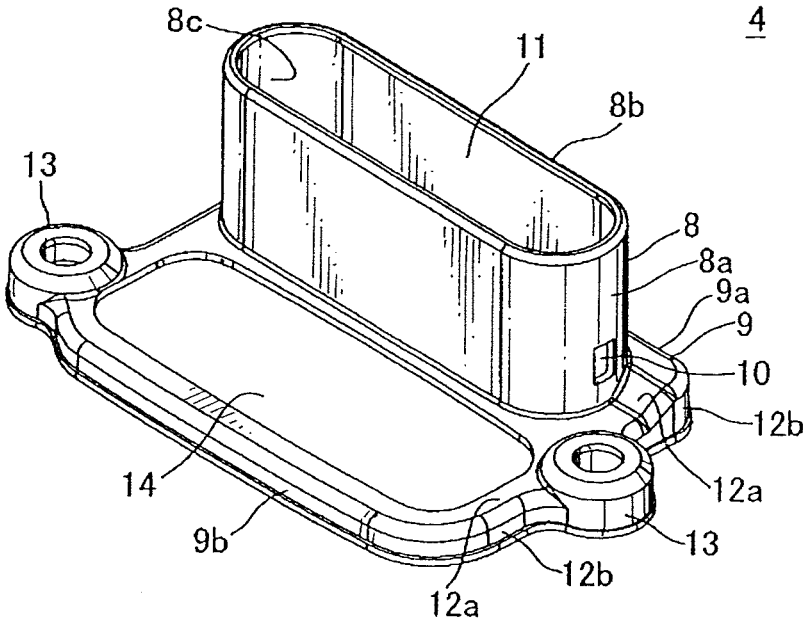
FIG. 2 is a perspective view of shield shell of the shield connector.

As shown in FIG. 2, the shield shell 4 includes an elliptical-cross-sectional vertical ring wall 8 and a flange 9 continued integratedly and vertically to a bottom edge of the ring wall 8. The ring wall 8 is formed with right and left semicircle-cross-sectional curved walls 8*a* at an end along a long span of elliptical shape, and front and rear straight walls 8*b* parallel to each other at an end along a short span of elliptical shape. A vertical-long rectangular hole 10 for locking the connector housing (locked member) is arranged respectively at a bottom area of the right and left curved walls 8*a*. The hole 10 is communicated with a space 11 passing up and down through the ring wall 8.

The flange 9 includes a rear frame portion 9*a* continued to the ring wall 8 as a rear-half the flange 9, and a front frame portion 9*b* continued to the rear frame portion 9*a* in the same horizontal plane as a front-half the flange 9. Both of the rear and front frame portions 9*a* and 9*b* is formed by a horizontal wall 12*a* and a vertical wall 12*b* with an L-shape cross-section, and has a pair of bolt inserting portions 13 at right and left side thereof and the front frame portion 9*b* includes a long-sideways rectangular opening 14.

Figure 3:
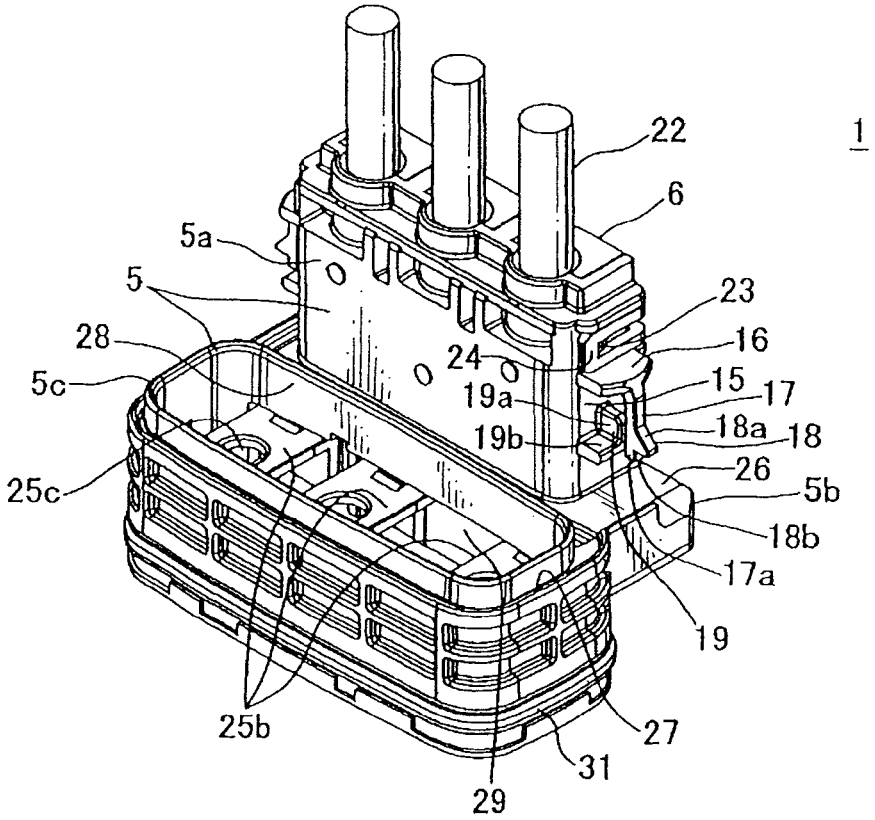
FIG. 3 is a perspective view of an embodiment of a connector housing of the shield connector.
Figure 4:
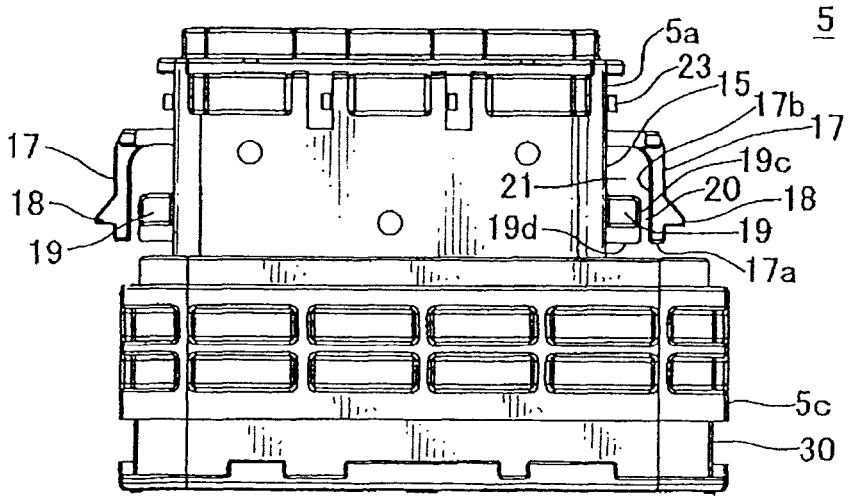
FIG. 4 is a front view of only connector housing of the shield connector.

As shown in FIGS. 3 and 4, the connector housing 5 is formed by a rear upper vertical-long rectangular receiving section 5*a*, a horizontal-long rectangular receiving section 5*b* continued integratedly to a bottom of the receiving section 5*a*, and a front vertical-long rectangular tubular receiving section 5*c* continued integratedly to the lower receiving section 5*b*.

A horizontal projecting wall 16 is provided at an outer surface 15 of each of right and left vertical side walls 15 of the rear half upper receiving section 5*a*. A lock arm 17 is vertically arranged integratedly and downwardly from a tip end of the projecting wall 16. The lock arm 17 includes an outward projection 18 at a bottom thereof. The projection 18 includes an upper slant surface 18*a* and a lower horizontal lock surface 18*b*. The lock arm 17 includes a short bottom end 17*a* extending from a bottom of the projection 18. Thus, the lock arm 17 is formed by an arm main body 17 and the projection 18. The projecting wall 16 can be defined as a portion of the lock arm 17.

A stopper 19 corresponding to the lock arm 17 is provided integratedly at the side wall 15 below the projecting wall 16 inside the lock arm 17, that is inner area along a bending direction. The stopper 19 includes a vertical wall 19*a* and a horizontal wall 19*b* intersecting the vertical wall 19*a* at a bottom the vertical wall 19*a*. A vertical outer surface 19*c* of the vertical wall 19*a* (FIG. 4) corresponds close to an inner surface 17*b* of the lock arm 17.

As shown in FIG. 4, the bottom end 17*a* of the lock arm 17 is arranged in the same horizontal plane as a bottom end 19*c* of the stopper 19. A gap 20 between the inner surface 17*b* of the lock arm 17 and the outer surface 19*c* of the stopper 19 is designed to be enough smaller than a gap 21 between the inner surface 17*b* of the lock arm 17 and a sidewall outer surface 15 of the housing receiving section 5*a*. In this embodiment, the gap 20 between the inner surface 17*b* of the lock arm 17 and the outer surface 19*c* of the stopper 19 is designed about a ¼ of a projecting length of the stopper 19.

The holder 6 (FIG. 3) is attached at a rear half upper portion of the rear upper receiving section 5*a* of the connector housing 5. The holder 6 holds an insulation outer cover 22 of an electric wire 22 or a not-shown waterproof rubber plug arranged at the insulation outer cover for preventing pulling-out. The holder 6 is fixed at the rear upper receiving section by engaging a flexible lock frame 24 to a small projection 23 at an upper portion of the projecting wall 16. A not-shown core wire of the electric wire 22 is connected with a vertical portion 25*a* of a conductive metal L-shaped terminal 25 (FIG. 6) by crimping. A horizontal portion 25*b* (FIG. 3) having a round hole 25*c*, which is connected with a not-shown terminal at the apparatus by bolt-fixing, projects into the front receiving section 5*c* of the connector housing 5. The front receiving section 5*c* has an upper step portion 27 in the same horizontal plane as a top wall surface 26 of the rear lower receiving section 5*b* (FIG. 3).

The rear lower receiving section 5*b* of the connector housing 5 may be separated to upper portion and lower portion, and the front receiving section 5*c* is provided at a rear wall 28 (FIG. 3) with a long-sideways terminal passing hole 29. The electric wire 22 with a terminal 25 orientated to position the terminal 25 lower is inserted into the rear receiving sections 5*a*, 5*b* from a bottom thereof, so that the terminal 25 'FIG. 6) is assembled in the connector housing 5. A ring-shaped waterproof packing 31 (FIG. 3) for an inner surface of a not-shown hole of the case 2 (FIG. 1) of the apparatus is arranged in a horizontal groove 30 (FIG. 4) around a lower portion of the front receiving section 5*c*. In the description, front, rear, right, left, upper and lower directions are defined conveniently for explanation, and does not always correspond to a mounting direction of the shield connector 1 to the apparatus.

Figure 5:
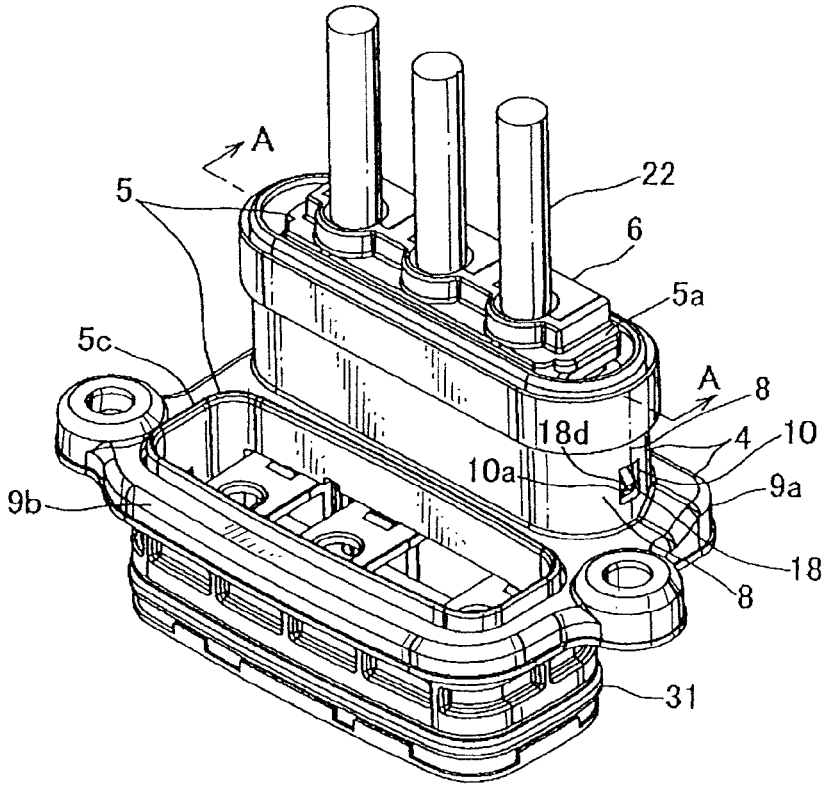
FIG. 5 is a perspective view of the shield connector.

The shield shell 4 shown in FIG. 2 is mounted from a top side to the connector housing 5 shown in FIG. 3 (the connector housing 5 shown in FIG. 3 is inserted from a bottom side into the shield shell 4 shown in FIG. 2). At the time, the electric wire 22 is previously inserted into the ring wall 8 of the shield shell 4, and as shown in FIG. 5, the rear upper receiving section 5*a* of the connector housing 5 is inserted and received in the ring wall 8 of the shield shell 4. The rear lower receiving section 5*b* (FIG. 3) of the connector housing 5 is inserted and received inside the rear frame portion 9*a* of the shield shell 4. The front frame portion 9*b* of the shield shell 4 is mounted at an outer top portion of the front receiving section 5*c* of the connector housing 5.

Figure 6:
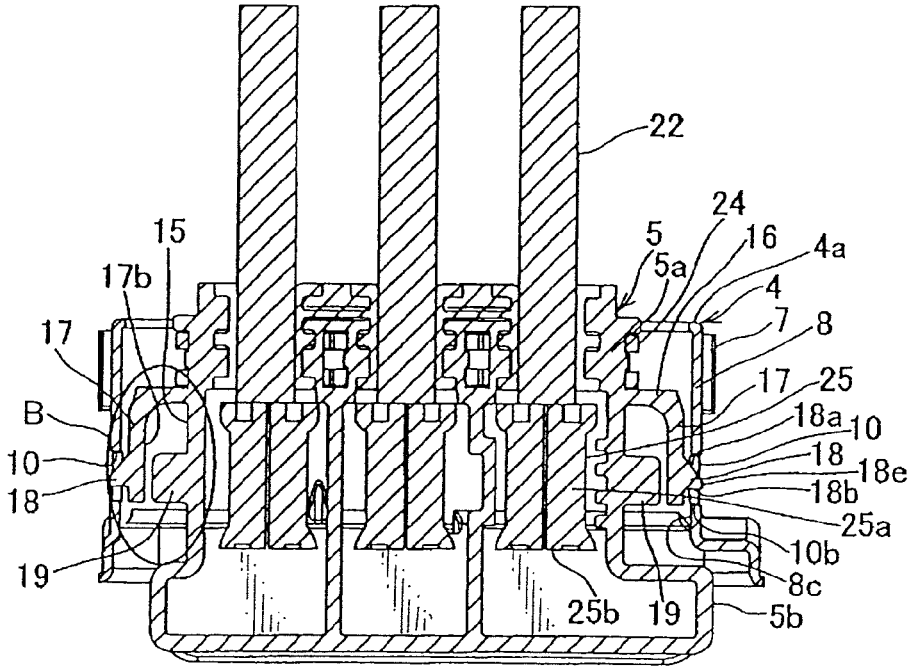
FIG. 6 is a cross-sectional view taken along the line A-A in FIG. 5 for showing a lock mechanism of the shield connector.

Simultaneously, the projections 18 of the right and left lock arms 17 of the rear upper receiving section 5*a* of the connector housing 5 are engaged with the right and left holes 10 of the ring wall 8 of the shield shell 4. As shown in FIGS. 5 and 6, the projection 18 is located in the center of the hole 10, and as shown in FIG. 5, there is a small gap between front rear side surfaces 18*d* of the projection 18 and front and rear side surfaces 10*a* of the hole 10. As shown in FIG. 6, there is a small gap between upper and lower side surfaces 18*a*, 18*b* (the upper side surface is slant surface 18*a*) of the projection 18 and upper and lower side surfaces 10*b* of the hole 10. A top end 18*e* of the projection 18 projects outwardly through the hole 10.

Figure 7:
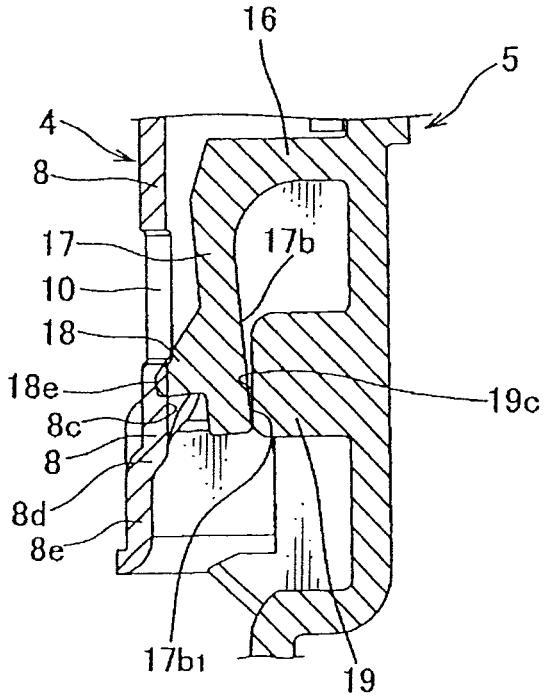
FIG. 7 is a partially expanded cross-sectional view of B area (main part of the lock mechanism of the shield connector) shown in FIG. 6 for action (press-fit)

As shown in FIG. 7, when the shield shell 4 is pushed from the top of the connector housing so as to insert the connector housing 5 into the shield shell 4, the top end 18*e* of the projection 18 of the lock arm 17 is slid on an inner surface of the ring wall of the shield shell 4, and the lock arm 17 is bent inwardly. A lower end inner surface 17*b*1 of the lock arm 17 is abutted on a lower outer surface 19*c* of the stopper 19, so that the lock arm is prevented from bending moreover and the lock arm 17 is inclined inwardly about the upper projecting wall 16.

After the condition, the shield shell 4 is continuously pushed, so that the lock arm 17 is pressed more inwardly from the condition shown in FIG. 7. Thereby, the inner surface 17*b* of the lock arm 17 is abutted overall on the outer surface 19*c* of the projecting wall 19 and the lock arm 17 is prevented completely from bending. In the condition, the top end 18*e* of the projection 18 pushes the inner surface 8*c* of the ring wall 8 outwardly and the projection 18 is pushed in along the inner surface 8*c* of the ring wall 8. In FIG. 7, for easily understanding, the projection 18 is shown to overlap the wall 8 as a press-fit condition.

Figure 8:
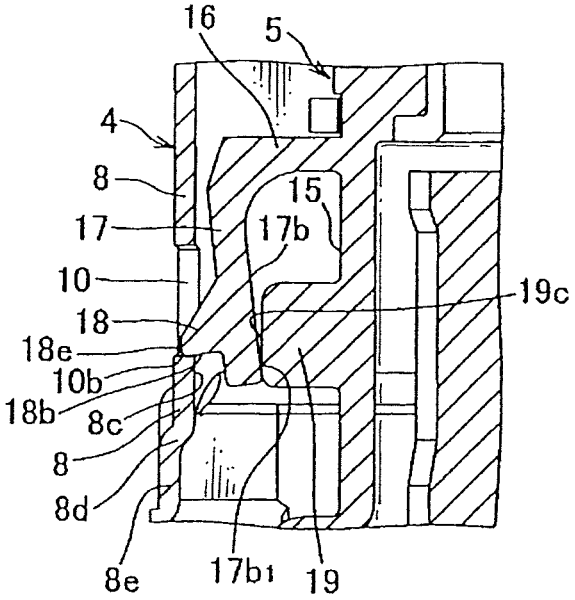
FIG. 8 is a partially expanded cross-sectional view of B area shown in FIG. 6 for action (start locking).

Successively, as shown in FIG. 8, the top end 18*e* of the projection 18 is inserted into the hole 10 of the ring wall 8, and simultaneously the lock arm 17 is released from bending condition. Thereby, as shown in FIG. 6, the lock arm 17 is restored to be vertical, and the projection 18 is completely engaged into the hole 10 with a large lock area. FIG. 8 shows a condition that the projection 18 just starts to penetrate into the hole 10 as the half engaging state before restoring. The half engaging state of the projection 18 means that a part of lock surface 18*b* at a top end of the projection 18 corresponding to a half length of the hole 10 is engaged in a half of the lower surface 10*b* of the hole 10.

Thus, the lock arm 17 is operated in order of bending, press-fitting and restoring, so that as shown in FIG. 7, the projection 18 is moved back inwardly by bending the lock arm 17, and slide friction resistance between the top end 18*e* of the projection 18 and the inner surface 8*c* of the ring wall 8 is reduced (overlap value, that is press-fit value between the projection 18 and the inner surface 8*c* of the ring wall 8 is reduced). Thereby, assembling the shield shell 4 on the connector housing 5 can be easily and smoothly by a low insertion force. Also, amount of scraping or crushing the top end 18*e* of the projection 18 can be reduced. As shown in FIG. 8, by restoring the lock arm 17, the large overlap area, that is lock area, can be secured, so that the shield shell 4 can be locked with the connector housing 5 by a large lock force.

As shown in FIG. 6, in the complete restoring condition of the lock arm 17, when an upward pulling force is acted on the shield shell 4 (downward pulling force is acted on the connector housing), in general, the lock arm 17 is unexpectedly bent and the projection 18 of the lock arm 17 may be unengaged from the hole 10 of the shield shell 4. But, as shown in FIG. 8, the lock arm 17 is abutted on the stopper 19 during bending so as to limit bending moreover. Thereby, the projection 18 is maintained in the half engaging condition in the hole 10, and the projection 18 is not pulled out of the hole 10. Therefore, an engaging force of the lock arm 17 is enlarged, so that it is securely prevented that the shield shell 4 is pulled out from the connector housing 5.

Accordingly, workability of assembling the shield shell 4 to the connector housing 5 can be improved, and it is securely prevented that the shield shell 4 having a heavy weight by aluminum die-cast is pulled out from the connector housing 5 when the shield connector 1 is transferred before the shield connector is assembled to the apparatus. After assembling the shield connector 1 is assembled to the apparatus, the shield shell 4 is fixed at the case 2 (FIG. 1) of the apparatus by bolt screwing. Thereby, the rear lower receiving section 5*b* and the front receiving section 5*c* are pressed from an upper side thereof by the flange 9, so that there is no possibility that the shield shell 4 or the connector housing 5 is pulled out.

As shown in FIG. 8, the vertical wall 8 (ring wall) is extended with a short length from a bottom of the hole 10 of the shield shell 4, and the vertical wall 8 is continued through a tapered portion 8*d* to a lower stepwise larger diameter vertical wall 8*e*. This shape is applied not only to a left side of the wall 8 in FIG. 8, but also to a right side of the wall 8 in FIG. 6.

When the connector housing 5 is inserted into the shield shell 4, at a previous step of FIG. 7 (before reaching a condition shown in FIG. 7), the top end 18*e* of the projection 18 of the lock arm 17 is slid along the inner surface of the lower larger diameter wall 8*e*, and the lock arm 17 is bent inwardly with a small deflection. Successively, the top end 18*e* of the projection 18 is slid smoothly along the inner surface of the tapered portion 8*d*, and slid more along the small diameter inner surface 8*c* so as to bend the lock arm 17 inwardly with a middle deflection until the lock arm 17 abuts on the stopper 19 as shown in FIG. 7. Thus, the lock arm 17 is bent gradually and stepwise, so that the shield shell 4 can be assembled to the connector housing 5 more smoothly.

As shown in FIG. 6, the shield ring 7 made of thin metal plate is fixed by press-fitting at a position above the hole 10 outside the holder 6 (FIG. 5). In the embodiment, the holder 6 touches tightly the insulation cover of the electric wire 22. The terminal 25 joined with the electric wire 22 is curved from the vertical portion 25*a* to a horizontal direction, and the vertical portion 25*a* is positioned in the rear top receiving section 5*a* of the connector housing 5, and the horizontal portion 25*b* is positioned through the rear lower receiving section 5*b* in the front receiving section 5*c* (FIG. 5).

In the above embodiment, an example by using the L-shape terminal 25 is described. When a straight-shape terminal (not shown) is used, a vertical long connector housing (not shown) which is formed with an upper receiving section, lower receiving section and a out-facing flange between the upper receiving section and the lower receiving section, is used, and the electric wire 22 is led upwardly from the upper receiving section, and a top end having a hole for bolt fixing of a terminal with the electric wire is led out from the lower receiving section. The flange and upper receiving section are covered by a ring wall and flange of a shield shell (not shown). As the embodiment mentioned above, the lock arm 17 arranged at the upper receiving section is bent so as to abut on the stopper 19, and the projection 18 of the lock arm 17 can be press-fitted into the inner surface 8*c* of the ring wall 8 and engaged with the hole 10.

In the above embodiment, the stopper 19 is arranged at the connector housing 5 corresponding to the lock arm 17. Oppositely, the stopper 19 can be arranged integratedly at the inner surface 17*b* of the lock arm 17. Thereby, when the lock arm 17 is bent, the stopper (19) of the lock arm 17 abuts on the vertical wall 15 of the upper receiving section 5*a* of the connector housing 5, and the lack arm 17 is prevented from bending moreover. In the condition, the projection 18 of the lock arm 17 can be press-fitted into the hole along the inner surface 8*c* of the shield shell 4.

In the case, the stopper (19) of the lock arm 17 may preferably have the same right-left length (height of projection) and the same up-down length as the stopper 19 in FIG. 6. When the gap 21 (FIG. 4) between the inner surface 17*b* of the lock arm 17 and the outer surface 15 of the receiving section 5*a*, that is the height of projecting wall 19, is smaller than the value in FIG. 6, the height of projection 18 is designed smaller. When the inner surface 17*b* of the lock arm 17 is moved close to the outer surface 15 of the receiving section 5*a*, instead of the stopper 19, the inner surface 17*b* of the lock arm 17 can be performed as the stopper. When the lock arm 17 is bent, the inner surface 17*b* of the lock arm 17 abuts on the outer surface 15 of the receiving section 5*a*, and in the condition, the projection 18 of the lock arm 17 can be press-fitted into the inner surface 8*c* of the shield shell 4.

In the above embodiment, the lock arm 17 is extended downwardly and the projection 18 is arranged at the lower area of the lock arm 17. The lock arm 18 can be extended upwardly and the projection 18 can be arranged at an upper area of the lock arm 17. In the case, the projection 18 of the lock arm 17 is engaged with, instead of the hole 10 of the shield shell 4, a not-shown recess or a step (locked member) of at the top end 4*a* (FIG. 6) of the shield shell 4.

In the above embodiment, the connector which is mounted directly at the apparatus so as to connect the terminal 25 of the shield connector 1 to the terminal of the apparatus is described as an example. For not only the terminal of the apparatus but also a terminal of a mating connector which is connected with the terminal 25 of the shield connector 1 by bolt fixing, the lock arm 17 of the present embodiment can be stopped in a half way of bending, and the projection 18 of the lock arm 17 can be press-fitted into the shield shell 4.

INDUSTRIAL APPLICABILITY

In the lock mechanism of shield connector according to the present invention, when the conductive shield shell is assembled to the insulation connector housing, by reducing the deflection of the lock arm, the lock arm can be press-fitted smoothly along the inner surface of the shied shell without scrape of the projection of lock arm, and workability of assembling the shield shell to the connector housing can be improved. By controlling unexpected deflection of the lock arm after engaging the projection of the lock arm with the locked member of the shield shell, the shield shell can be prevented securely from pulling out from the connector housing. Therefore, the lock mechanism can be applied to improve reliability of lock of the shield connector during transference of the shield connector.

REMARKS

1 Shield connector
4 Shield shell
5 Connector housing
8*c* Inner surface
10 Hole (locked member)
15 Side wall (outer surface)
17 Lock arm
17*b* Inner surface
18 Projection
19 Stopper

The invention claimed is:

1. A lock mechanism of a shield connector, comprising:

an insulation connector housing;

a flexible lock arm having a lock projection projecting outwardly and being arranged on the connector housing;

a conductive shield shell in which the connector housing is inserted;

a locking member provided on the shield shell so as to be locked with the lock projection; and a stopper which limits deflection of the lock arm, the stopper disposed between the lock arm and the connector housing and configured such that the lock arm is prevented from bending to unlock the lock arm when the lock projection is half-locked with the locking member, wherein the stopper projects to an outer surface of the connector housing from the lock arm such that the lock arm is bent inwardly and the lock projection is press-fitted along an inner surface of the shield shell to push the inner surface of the shield shell outwardly and prevent further inward bending of the lock arm by the stopper's abutment against the connector housing while the connector housing is inserted into the shield shell.

2. A lock mechanism of a shield connector, comprising:

an insulation connector housing;

a flexible lock arm having a lock projection projecting outwardly and being arranged on the connector housing;

a conductive shield shell in which the connector housing is inserted;

a locking member provided on the shield shell so as to be locked with the lock projection;

a stopper which limits deflection of the lock arm, the stopper disposed between the lock arm and the connector housing and configured such that the lock arm is prevented from bending to unlock the lock arm when the lock projection is half-locked with the locking member, wherein the stopper projects to an inner surface of the lock arm from the outer surface of the connector housing such that the lock arm is bent inwardly and the lock projection is press-fitted along an inner surface of the shield shell to push the inner surface of the shield shell outwardly and prevent a further inward bending of the lock arm by the stopper's abutment against the lock arm while the connector housing is inserted into the shield shell.

* * * * *